US007222621B1

(12) United States Patent
Wung

(10) Patent No.: US 7,222,621 B1
(45) Date of Patent: May 29, 2007

(54) BREATHING TUBE FASTENING STRUCTURE

(76) Inventor: Chin-Hsien Wung, No. 46, Lane 267, Huacheng Rd., Xinzhuang City, Taipei County 242 (TW)

( * ) Notice: Subject to any disclaimer, the term of this patent is extended or adjusted under 35 U.S.C. 154(b) by 0 days.

(21) Appl. No.: 11/322,224

(22) Filed: Jan. 3, 2006

(51) Int. Cl.
*B63C 11/16* (2006.01)
*B63C 11/02* (2006.01)
*F16L 25/00* (2006.01)

(52) U.S. Cl. ..... 128/201.27; 128/201.11; 285/420

(58) Field of Classification Search ..... 128/201.11, 128/201.27; 24/3.7, 3.9, 3.11, 3.12, 3.13; 403/109.1, 109.2, 109.3, 109.5, 109.8; 285/420
See application file for complete search history.

(56) References Cited

U.S. PATENT DOCUMENTS 5,906,199 A * 5/1999 Budzinski ..... 128/201.11
6,352,075 B1 * 3/2002 Wang ..... 128/201.11
2004/0079365 A1 * 4/2004 Sato ..... 128/201.11
2006/0112957 A1 * 6/2006 Johnson ..... 128/201.11

* cited by examiner

*Primary Examiner*—Justine R. Yu
*Assistant Examiner*—Amadeus Lopez
(74) *Attorney, Agent, or Firm*—Birch, Stewart, Kolasch & Birch, LLP

(57) ABSTRACT

The invention relates to a "breathing tube fastening structure", mainly comprising a fastener, buckle, pipe hoop, snatch-hook and snatch-hook stand and snatch-hook stand. The invention is fixed on the exterior of the lateral side of a head strap.

The characteristics of the invention include that the fastener has two knobs formed on both lateral sides, both are correspondently disposed in two round holes and a coupling portion, the snatch-hook has one end thereof recessed with two projections extended to lock inside two round holes on the surface of the snatch-hook, an opening form extend two hook portions and pierced through a hooking groove disposed on the surface of the snatch-hook stand, moreover, a round grip portion of the pipe hoop is locked into a sliding groove of the snatch-hook stand, thereby enabling the pipe hoop to revolve. When a breathing pipe is sleeved in the pipe hoop, the fastener loosens the pipe hoop, thereby enabling the breathing pipe to shift up or down.

4 Claims, 5 Drawing Sheets

BREATHING TUBE FASTENING STRUCTURE

BACKGROUND OF THE INVENTION

I. Field of the Invention

The present invention relates to fastening structure of a breathing tube, especially a breathing tube that is used for snorkeling and is fixed on the exterior of the lateral side of a head strap for clamping said breathing tube. Therefore, when said breathing tube is clamped by the invention, it has the advantages of freely revolving and rapid disassembly without being hindered from shifting up or down.

II. Description of the Prior Art

Generally, a conventional breathing tube is frequently applied to water sports—such as swimming, snorkeling or diving which enable a user to observe things under the sea with a hydroscope applied together without coming up to breath. Said breathing tube is commonly affixed to a head strap of a mask, so that a user can easily move a mouthpiece of said breathing tube (as shown in FIG. 1) to his/her mouth. A conventional fastening clamp A is mainly formed in a round and sealed shape, having the shape of the inner rim thereof match up with the outer rim of a breathing tube B. In addition, the size of the internal diameter thereof is slightly smaller than the external diameter of the breathing tube B. When the fastening clamp A sleeves over the breathing tube B, both of the fastening clamp A and the breathing tube B tightly close to each other enabling a clip C to clip the head strap of a hydroscope, so as to achieving the objective of fixing the breathing tube B thereon. Even though said fastening clamp A possesses the fastening effect, it is found that said clip C for fastening the head strap of a hydroscope is able to adjust the position of the breathing tube B on the left and right sides. Consequently, water easily enters into the breathing tube B when a diver leans forwards. In other words, said fastening clamp A and the breathing tube B should be designed in one piece; nevertheless, a user has to repurchase a breathing tube B when said fastening clamp A is broken, so as to cause the inconvenience to a diver, even make the user to go against the environmental protection.

SUMMARY OF THE INVENTION

In view of the drawbacks of a fastening clamp of said breathing tube of a prior art, an innovative "breathing tube fastening structure" is therefore disclosed hereafter.

To achieve the foregoing objectives, the main objective of the present invention is to provide a breathing tube that is used for snorkeling. The invention is fixed on the exterior of the lateral side of a head strap for clamping said breathing tube. Therefore, said breathing tube is clamped by the invention having the advantages of freely revolving and rapid disassembly without being hindered from shifting up or down.

To achieve the foregoing objective, the "breathing tube fastening structure" of the invention mainly comprises a fastener, a buckle, a pipe hoop, a snatch-hook and a snatch-hook stand. The invention is fixed on the exterior of the lateral side of a head strap for clamping said breathing tube, which is clamped by the invention having the advantages of freely revolving and rapid disassembly without being hindered from shifting up or down. The characteristics of the invention include that the fastener has a fastener body extended downwards from the main body and two knobs are formed on both lateral sides thereof; the buckle has four claws formed on both lateral sides thereof; the pipe hoop has an opening thereon vertically set a coupling portion, the inner part thereof set two round holes and the rear side thereof set a round grip portion; the snatch-hook sets an opening and two hook portions extended thereon, one end of the hook portions is recessed with two projections extended; the snatch-hook stand has two round holes, a mounting panel and a hooking groove disposed on the surface thereof and has a sliding groove opened on the inner part thereof.

Said breathing tube fastening structure of the invention enables the four claws set on the both lateral sides of the buckle to snap at the coupling portion of the pipe hoop, subsequently, the knobs of the fastener hook in the round holes of the pipe hoop, so as to form the fastener, the buckle and the pipe hoop in integral. The fastener is a main button enabling the breathing tube to be shifted up or down by a diver, two projections of the snatch-hook and two round holes of the snatch-hook stand are snapped together forming a movable end. Subsequently, the hook portions of the snatch-hook and the hooking groove of the snatch-hook stand are gripped together in integral, thereby enabling the snatch-hook to be quickly unlocked therefrom and locked thereto. The round grip portion of the pipe hoop is locked into said sliding groove of the snatch-hook stand and the mounting panel and the round grip portion are buckled in integral, subsequently, the snatch-hook is buckled into the snatch-hook stand with said head strap passing through, thereby enabling the round grip portion on the pipe hoop to freely revolve inside the sliding groove on the snatch-hook stand and the activation of the fastener enables the breathing tube to be shifted up or down for a diver to freely adjust a proper angel for use.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Further aspects, objects, and desirable features of the invention will be better understood from the detailed description and drawings that follow in which various embodiments of the disclosed invention are illustrated by way of examples.

Figure 1:
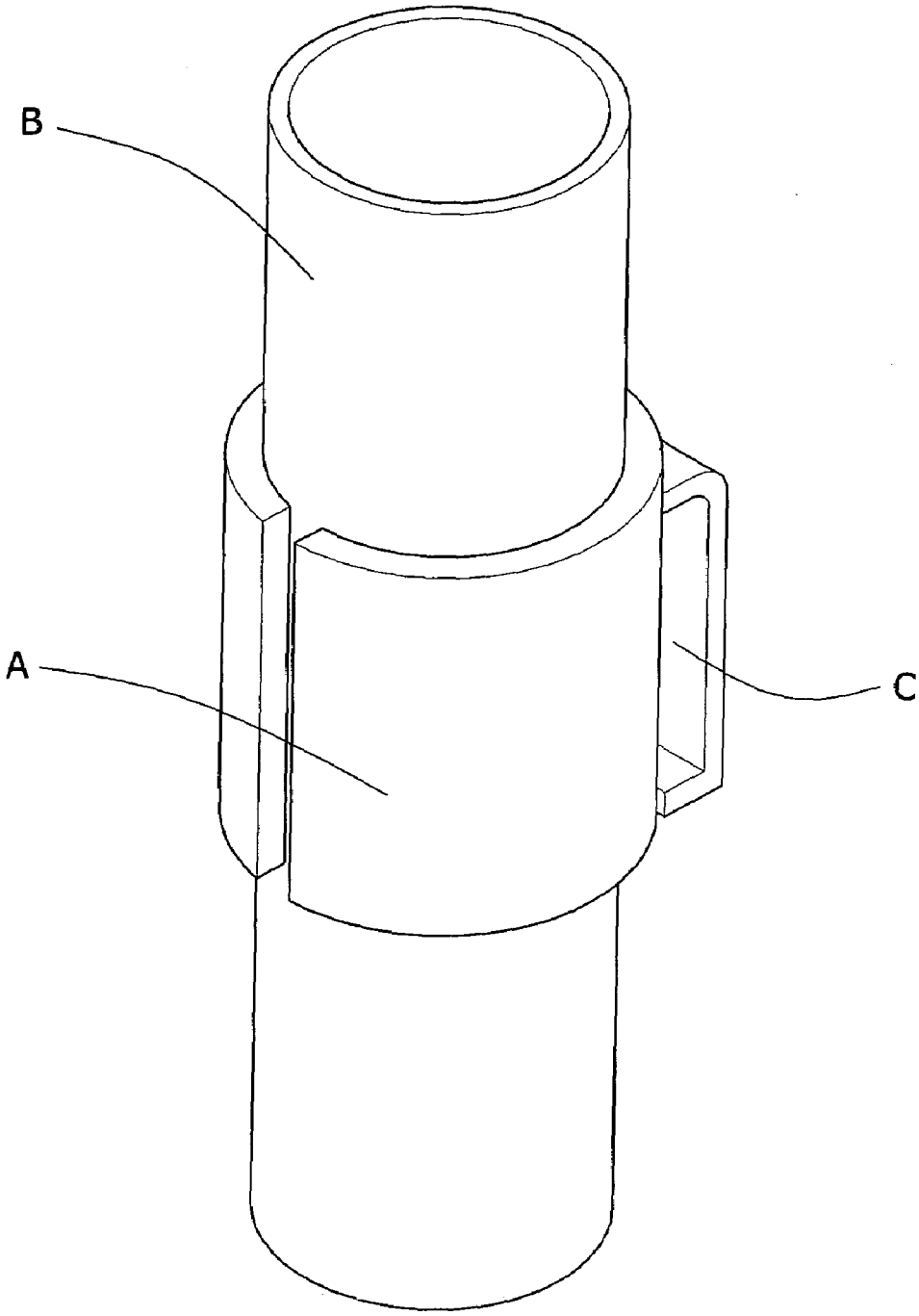
Fig.1(PRIOR ART)
FIG. 1 is a three-dimensional structural view of a prior art.
Figure 2:
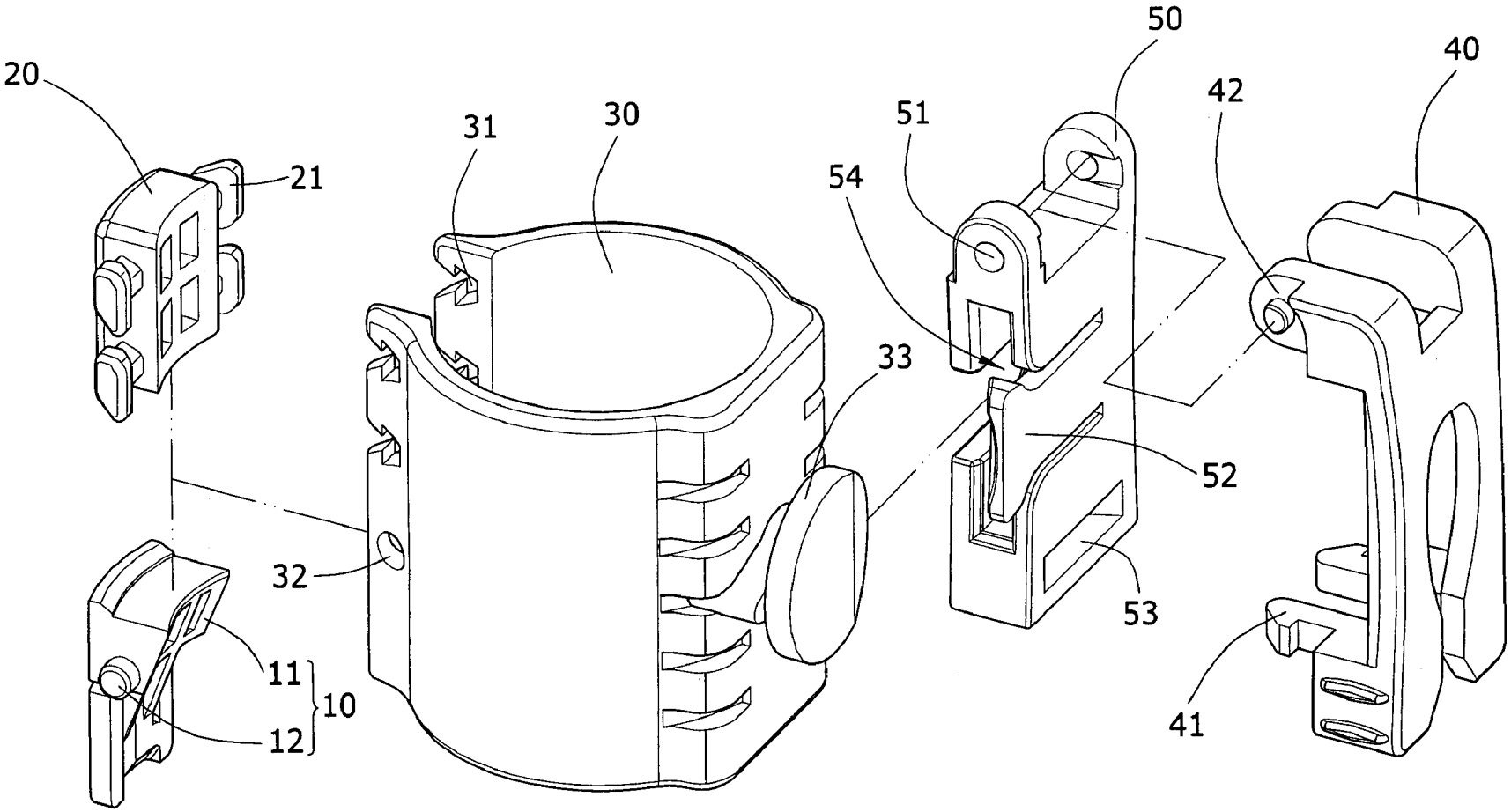
FIG. 2 is a three-dimensional exploded view of the present invention.

With reference to FIG. 2, the "breathing tube fastening structure" of the invention mainly comprises a fastener 10, a buckle 20, a pipe hoop 30, a snatch-hook 40 and a snatch-hook stand 50, in addition, is fixed on the exterior of the lateral side of a head strap for clamping a snorkeling breathing tube, which is clamped by the invention having the advantages of freely revolving and rapid disassembly without being hindered from shifting up or down, wherein;

The fastener 10 has a fastener body 11 extended downwards from the main body and two knobs 12 are formed on both lateral sides thereof; the buckle 20 has four claws 21 formed on both lateral sides thereof; the pipe hoop 30 has an opening thereon vertically set a coupling portion 31, the inner part thereof set two round holes two round holes 32 and the rear side thereof set a round grip portion 33; the snatch-hook 40 sets an opening and two hook portions 41 extended thereon, one end of the hook portions is recessed with two projections 42 extended; the snatch-hook stand 50 has two round holes 51, a mounting panel 52 and a hooking groove 53 disposed on the surface thereof and has a sliding groove 54 opened on the inner part thereof.

Figure 3:
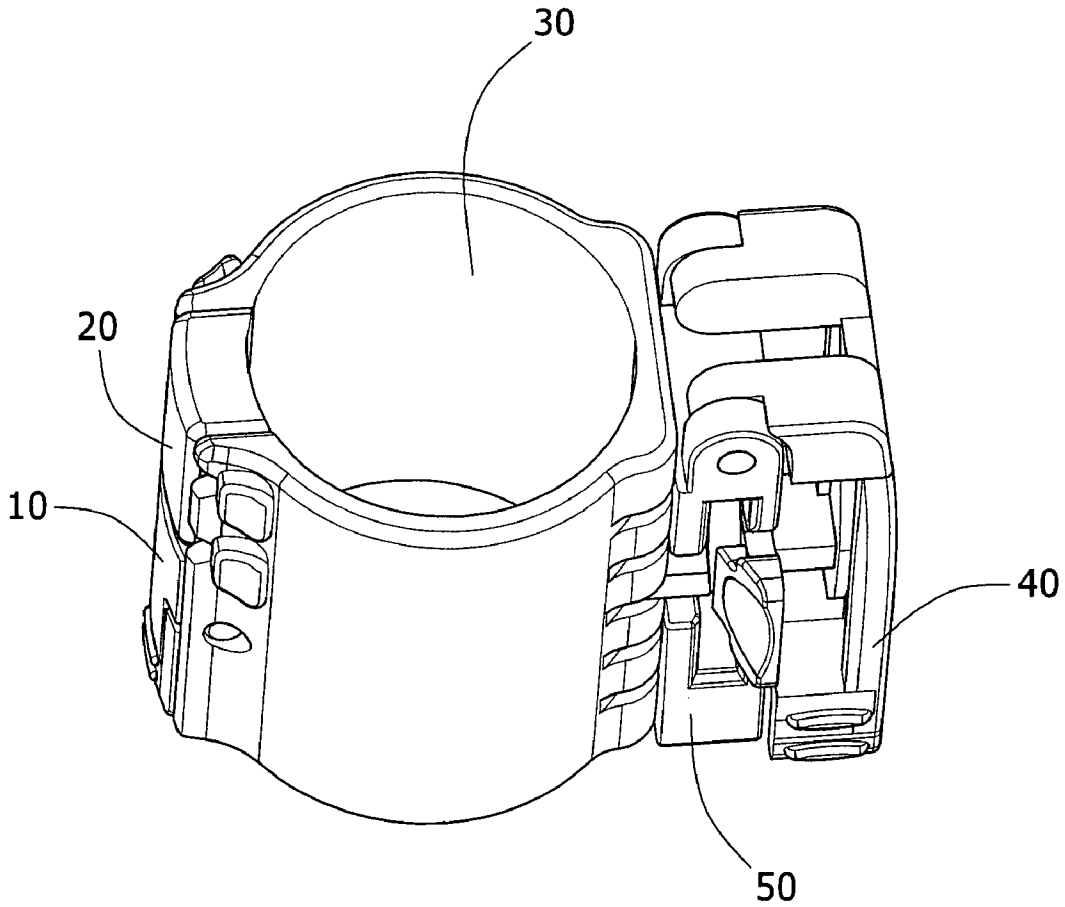
FIG. 3 is a three-dimensional structural view of the present invention.

With reference to FIGS. 2 and 3, breathing tube fastening structure of the invention enables the four claws 21 set on the both lateral sides of the buckle 20 to snap at the coupling portion 31 of the pipe hoop 30, subsequently, the knobs 12 of the fastener 10 hook in the round holes 30 of the pipe hoop 30, so as to form the fastener 10, the buckle 20 and the pipe hoop 30 in integral, thereby enabling the pipe hoop 30 to secure the fastener 10. Said fastener 10 is a main button enabling the breathing tube to be shifted up or down by a diver, the two projections 42 on the snatch-hook 40 and two round holes 51 of the snatch-hook stand 50 are snapped together forming a movable end, subsequently, the hook portions 41 of the snatch-hook 40 and the hooking groove 53 of the snatch-hook stand 50 are gripped together in integral, thereby enabling the snatch-hook to be quickly unlocked therefrom and locked thereto. The round grip portion 33 of the pipe hoop 30 is locked into said sliding groove 54 of the snatch-hook stand 50 and the mounting panel 52 and the round grip portion 33 are buckled in integral, subsequently, the snatch-hook 40 is buckled into the snatch-hook stand 50 with said head strap passing through, thereby enabling the round grip portion 33 on the pipe hoop 30 to freely revolve at 360 degrees inside the sliding groove 64 on the snatch-hook stand 50 and the activation of the fastener 10 enables the breathing tube to be shifted up or down for a diver to freely adjust a proper angel for use.

Figure 4:
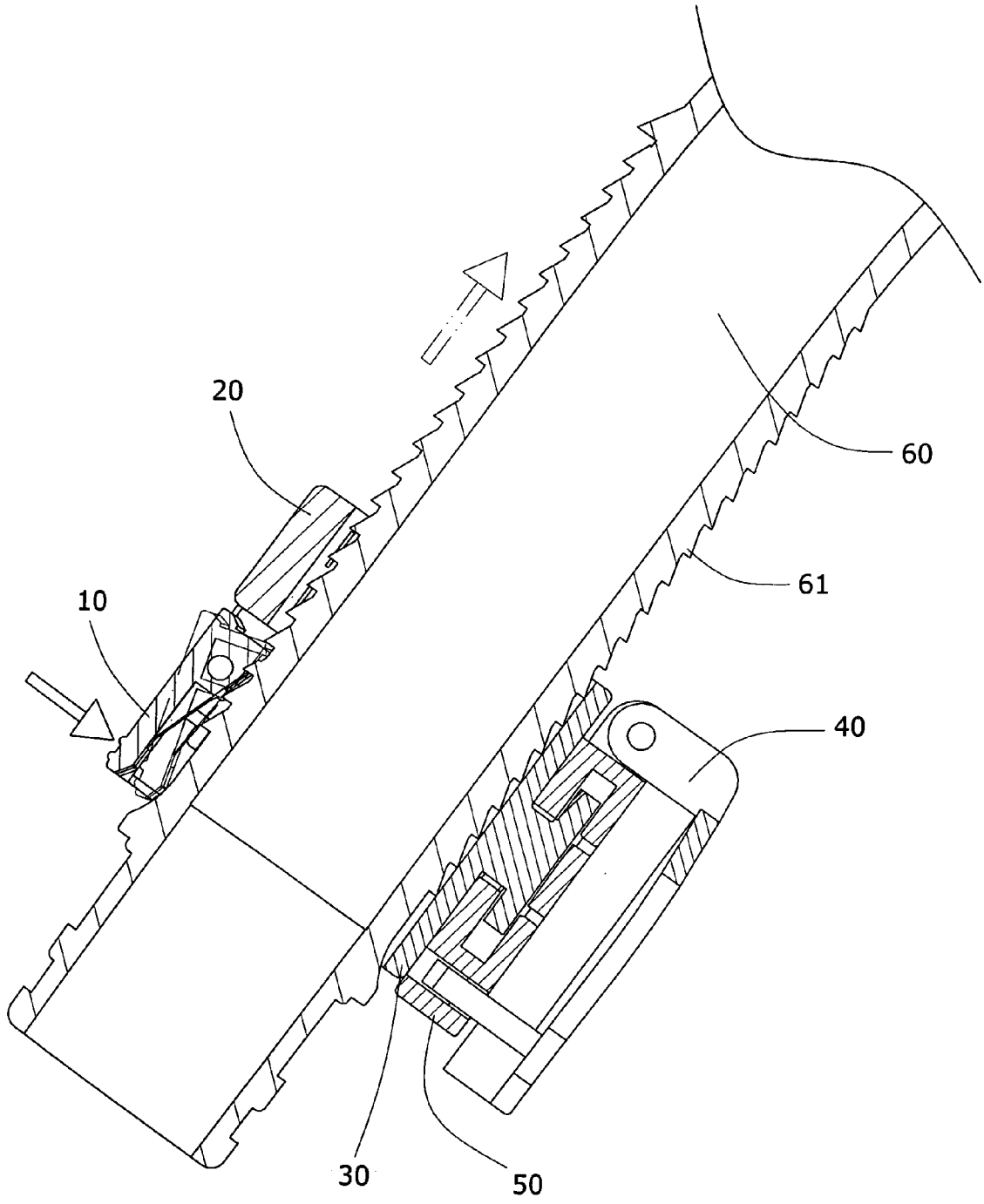
FIG. 4 is a cross-sectional view showing the actuation of the present invention.
Figure 5:
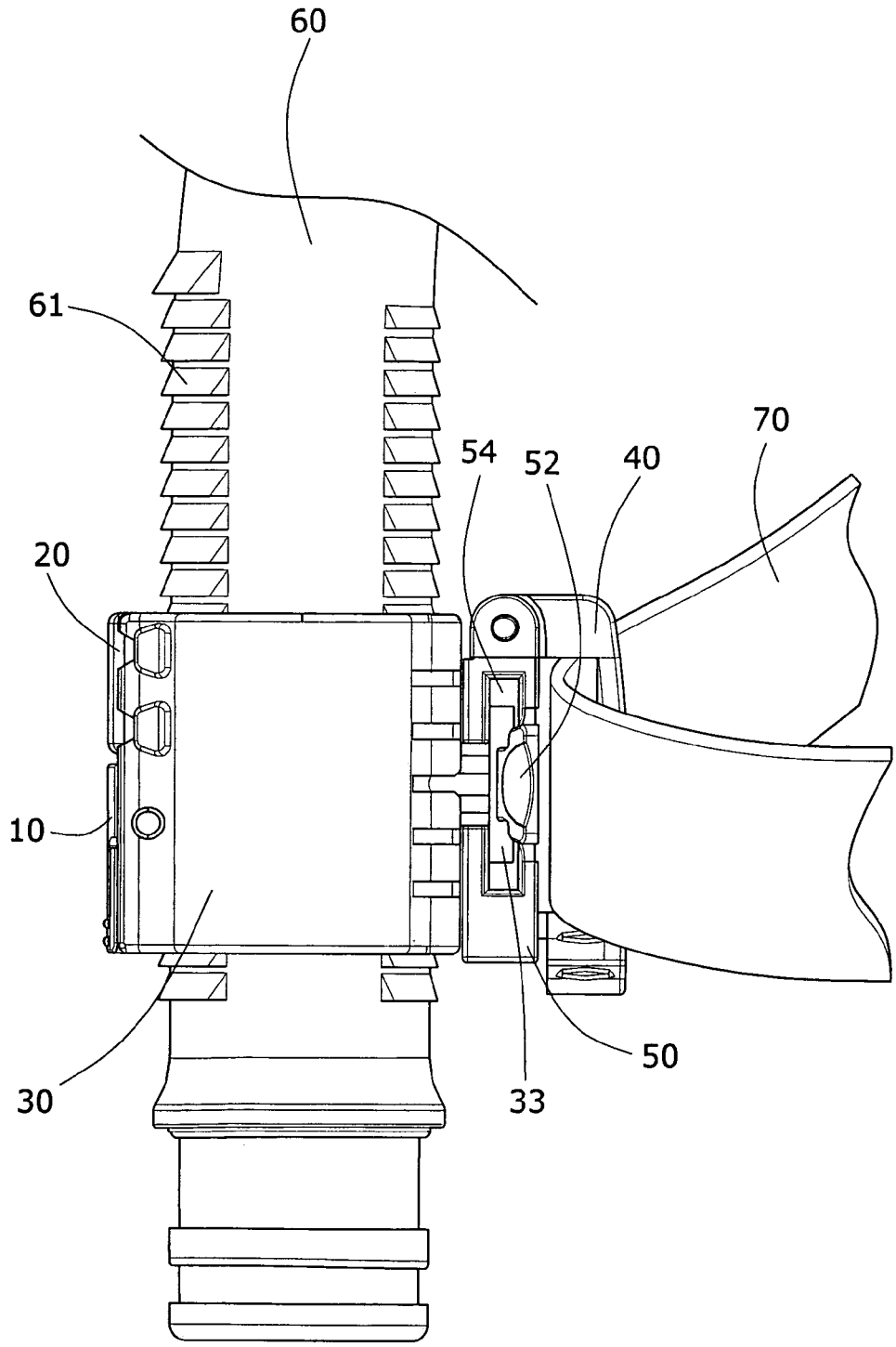
FIG. 5 is a prospective view showing the assembly of head strap and the present invention.

With reference to FIGS. 4 and 5, when a breathing tube 60 is either improperly located or required to be positioned at a certain angle, the invention enables the lower rim of the fastener 10 to be pressed down and the upper rim of the fastener 10 to be raised, in the meanwhile, a teeth portion 61 of the breathing tube 60 is loosen, thereby enabling the invention to shift up or down on the teeth portion 61 of the breathing tube 60. When a head strap 70 pierces through the snatch-hook 40 and the snatch-hook stand 50, the hook portions 41 of the snatch-hook 40 has to be opened, enabling a movable end to be formed at a 45-degree angle by the snatch-hook 40 and the snatch-hook stand 50 for said head strap 70 to pierce through therein. Subsequently, the hook portions 41 are pressed down to buckle the hooking groove 53 of the snatch-hook stand 50 after the head strap 70 is pierced through said snatch-hook 40 and the snatch-hook stand 50, thereby hindering the head strap 70 from being loosened. When a diver wants to quickly remove the head strap 70, s/he needs to open the hook portions 41 at the time when the snatch-hook 40 and the snatch-hook stand 50 both form a movable end at a 45-degree angle and the round grip portion 33 on the pipe hoop 30 is locked into said sliding groove 54 of the snatch-hook stand 50, the diver enables the round grip portion 33 on the lower inclined plane thereof to be buckled in a mounting panel 52 and positioned in said sliding groove 54, thereby enabling the pipe hoop 30 to freely revolve therein until a proper position is found. At the same time, the upper rim of the fastener 10 is pressed down to fix and lock the position of the pipe hoop 30 on the breathing tube 60.

To sum up, the "breathing tube fastening structure" of the invention has the advantages of shifting up or down, freely revolving at 360 degrees and rapid disassembly, so as to possess the "practicability" and "advancement" in the industry field.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A breathing tube fastening structure comprising:

a fastener having a fastener body;

a buckle;

a pipe hoop, the fastener being pivotally mounted on the pipe hoop to be movable between a locked and an unlocked position, a breathing tube being received in the pipe hoop and the fastener body being engageable with and disengagable with notches formed on an exterior of the breathing tube, in the locked position the fastener body preventing movement of the pipe hoop relative to the breathing tube and in the unlocked position, the fastener body permitting sliding of the pipe hoop on the breathing tube, the pipe hoop having a protruding grip portion;

a snatch-hook; and a snatch-hook stand, the snatch-hook being pivotally connected to the snatch-hook stand to be movable between an open and a closed position, an opening being formed between the snatch-hook stand and the snatch-hook when the snatch-hook is in a closed position, the opening receiving a head strap for a breathing tube, the snatch-hook being readily movable between the open position and closed position for connection and removal of the head strap, the snatch-hook stand further having an opening for receiving the grip portion of the pipe hoop whereby the snatch-hook and snatch-hook stand are rotatable relative to the pipe hoop.

2. The breathing tube fastening structure of claim 1, wherein the grip portion and the fastener are mounted on opposed sides of the pipe hoop, the grip portion having a round shape and the snatch-hook stand is rotatable about the trip portion.

3. The breathing tube fastening structure of claim 2, wherein the buckle is mounted on a same side of the breathing tube as the fastener, the buckle and the fastener being next to one another, the buckle having two claws on each side thereof, the claws being held by a coupling portion on the pipe hoop, the fastener having a knob on each side about which the fastener is pivotable, the knobs being received in holes in the pipe hoop, the holes for the knobs being beneath the coupling portion.

4. The breathing the fastening structure of claim 2, wherein the snatch-hook has a projection on each side which is mounted in holes on the snatch-hook stand, the snatch-hook being pivotable about an axis passing trough the projections, the snatch-hook another having at least one hook portion on an end opposite the end having the projections, the at least one hook portion being insertable into a hooking groove formed on the snatch-hook stand.

* * * * *